US006921181B2

(12) United States Patent
Yen

(10) Patent No.: US 6,921,181 B2
(45) Date of Patent: Jul. 26, 2005

(54) FLASHLIGHT WITH HEAT-DISSIPATION DEVICE

(76) Inventor: Mei-Feng Yen, P.O. Box No. 6-57, Junghe, Taipei 235 (TW)

( * ) Notice: Subject to any disclaimer, the term of this patent is extended or adjusted under 35 U.S.C. 154(b) by 60 days.

(21) Appl. No.: 10/612,899

(22) Filed: Jul. 7, 2003

(65) Prior Publication Data

US 2005/0007772 A1 Jan. 13, 2005

(51) Int. Cl.[7] ..... F21L 4/04
(52) U.S. Cl. ..... 362/206; 362/294; 362/389
(58) Field of Search ..... 362/206, 202, 362/204, 205, 208, 294, 389

(56) References Cited

U.S. PATENT DOCUMENTS 3,639,751 A * 2/1972 Pichel ..... 362/261
4,415,954 A * 11/1983 Schaefer ..... 362/202

* cited by examiner

*Primary Examiner*—Sandra O'Shea
*Assistant Examiner*—Mark Tsidulko
(74) *Attorney, Agent, or Firm*—Troxell Law Office, PLLC

(57) ABSTRACT

A flashlight structure with a heat-dissipation device is disclosed. The flashlight structure includes a base having a conducting point isolated with the base; a high-power luminary disposed on the base and having an anode electrode connecting with the conducting point and a cathode electrode connecting with the base; a power source having a positive terminal connecting to the conducting point and a negative terminal connecting to the base for providing the luminary with power; and a housing including the base and having plural heat sink for dissipating the heat produced by the high-power luminary, thereby preventing the flashlight from damage of device or diminution of use life.

11 Claims, 4 Drawing Sheets

FLASHLIGHT WITH HEAT-DISSIPATION DEVICE

BACKGROUND OF THE INVENTION (a) Field of the Invention

This invention relates to a flashlight structure, and more particularly to a flashlight structure with a heat-dissipation device.

(b) Description of the Prior Art

Flashlights are extremely useful as portable lighting devices. There are several types of the flashlights provided according to the requirement, wherein a flashlight with a high-power luminary is one of those developed directions. On the other hand, a light emitting diode (LED) is well considered as a luminary. Being compared with the conventional luminary, for example a pilot lamp, fluorescent lamps, an incandescent lamp and so on, the LED has several features of small volume, low heat-produced, low power consumption, long use life, high responding speed, environmental-protection, thin and compact. However, LED flashlight always has to include a LED array to put in use. Recently, high-power LED is developed and well down. Therefore, a high-power LED flashlight has practical applications. Unfortunately, a high-power LED would produce a lot of heat, and that will be a serious problem to limit its usefulness. The problem has to be solved.

Most flashlights comprise a cylindrical housing containing one or more batteries therein, a cap on one end of the housing containing a light source, such as a bulb or light emitting diode, a reflector and a lens cover over the light source. The light source is electrically connected in series with the batteries so that it can be turned on and off. Generally, some type of switch is provided to turn the light source on and off. To achieve more power and a stronger light, the flashlight is generally provided with two or more batteries in series and/or larger size batteries. The larger the number of batteries used to obtain an increase in power, the larger the housing that is required. Please refer to FIG. 1. It illustrates a high-power LED flashlight according to the prior art. As being shown in FIG. 1, the high-power LED flashlight structure includes a high-power LED luminary 11, a reflector 12, a base 13, a protecting housing 14, a lens cover 15, a casing having a power source 161 and a switch 17. Meanwhile the high-power LED luminary 11 is disposed on the base 13 and has the reflector 12 passing therethrough, wherein the reflector 12 is used for collecting and reflecting the light produced by the high-power LED luminary 11, and the base 13 is used for conducting with the power source 161. A user can decide to turn on or turn off the flashlight by means of controlling the switch 17. The protecting housing 14 and the casing 16 include the thread of screws for engaging with each other. When the protecting housing 14 and the casing 16 are combined together, the high-power LED luminary 14, the reflector 12 and the base can be included and fixed in the protecting housing 14. Furthermore, the protecting housing has an opening for passing the light therethrough, wherein the flashlight structure further includes a lens cover 15 for protecting the high-power LED luminary 11 completely.

Please refer to FIG. 2. It illustrates a cross-section structure of a high-power LED flashlight according to the prior art. As being shown in FIG. 2, the high-power LED luminary 11 is fixed on the base 13 and has the reflector 12 passing therethrough, and the base 13 is further fixed in the protecting housing 14. Meanwhile, the high-power LED luminary 11 has a cathode electrode connecting with the base 13, and an anode electrode connected to a conducting point 13, wherein the conducting point 131 is isolated with the base 13 via an isolating piece 132. When the protecting housing 14 and the power source 16 are combined together, the conducting point 131 can contact with a positive terminal 1611 of the power source (battery) 161 of the casing 16. The base 13, the protecting housing 14, and the casing 16 are formed by aluminum alloy. Accordingly, after the flashlight is assembled, the high-power LED luminary can be controlled via the switch of the bottom.

The prior high-power LED flashlight structures are easy to be operated and assembled, but they cause the heat-dissipating problem in application. The use life of the LED is related to the temperature of the environment near the LED chip. Hence, it is important to control the temperature for the LED. Usually, the LED will transform 10% electricity into light and 90% electricity into heat, but the prior art can't remove the heat produced by the luminary efficiently, thereby the use life of the flashlight is decreased. Therefore, it needs to provide a flashlight structure with a heat-dissipating device, which is capable of preventing the high-power luminary from break, being assembled easily and efficiently, and can rectify those drawbacks of the prior art and solve the above problems.

SUMMARY OF THE INVENTION

It is an object of the present invention to provide a flashlight structure with a heat-dissipating device, which prevents from heat accumulation, thereby decreasing the breakdown rate of the flashlight structure and increasing the use life of the high-power luminary.

In accordance with an aspect of the present invention, the flashlight structure includes a base having a conducting point isolated with the base; a high-power luminary disposed on the base and having an anode electrode connecting with the conducting point and a cathode electrode connecting with the base; a housing including the base and having plural heat sink for dissipating heat produced by the high-power luminary; a reflecting piece disposed around the high-power luminary for collecting and reflecting light produced by the high-power luminary; and a power source having a positive terminal connecting to the conducting point and a negative terminal connecting to the base for providing the high-power luminary with power.

Certainly, the high-power luminary can be a light emitting diode (LED).

Certainly, the base, the housing and the power source can be made of a heat-conducting and electric-conducting material.

Certainly, the heat-conducting and electric-conducting material can be an aluminum alloy.

Preferably, the flashlight structure further includes a switch connected to the power source for controlling a power supply condition of the power source.

Preferably, the power source further includes a holding sleeve disposed around the source for facilitating of holding.

Certainly, the holding sleeve can be made of a heat-insulating material.

Certainly, the heat-insulating material can be a rubber.

Certainly, the base and the housing can be of unity.

Certainly, the base and the housing can be produced by means of metal-injection molding (MIM) process.

In accordance with another aspect of the present invention, the flashlight structure includes a base having a conducting point isolated with the base; a high-power luminary disposed on the base and having an anode electrode connecting with the conducting point and a cathode electrode connecting with the base; a power source having a positive terminal connecting to the conducting point and a negative terminal connecting to the base for providing the luminary with power; and a housing including the base and having plural heat sink for dissipating heat produced by the high-power luminary, thereby preventing the high-power luminary of the flashlight structure from damage or diminution of use life.

Preferably, the base and the housing are made of a heat-conducting and electric-conducting material.

Certainly, the material can be an aluminum alloy.

Preferably, the base and the housing are of unity.

Certainly, the base and the housing can be produced by means of metal-injection molding (MIM) process.

Preferably, the flashlight structure includes a cover set engaged with the housing and covering the high-power luminary for protecting the high-power luminary.

In accordance with another aspect of the present invention, the housing structure for a flashlight having a high-power luminary, includes plural heat sink for dissipating heat produced by the high-power luminary, thereby preventing the high-power luminary of the flashlight structure from damage or diminution of use life.

Accordingly, the housing structure is made of a heat-conducting and electric-conducting material and the material is an aluminum alloy.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention discloses a high-power flashlight structure with a heat-dissipating device, and the objects and advantages of the present invention will become more readily apparent to those ordinarily skilled in the art after reviewing the following detailed description. The present invention needs not be limited to the following embodiment. It can be applied in a high-power LED luminary or other high-power luminaries etc.

Figure 1:
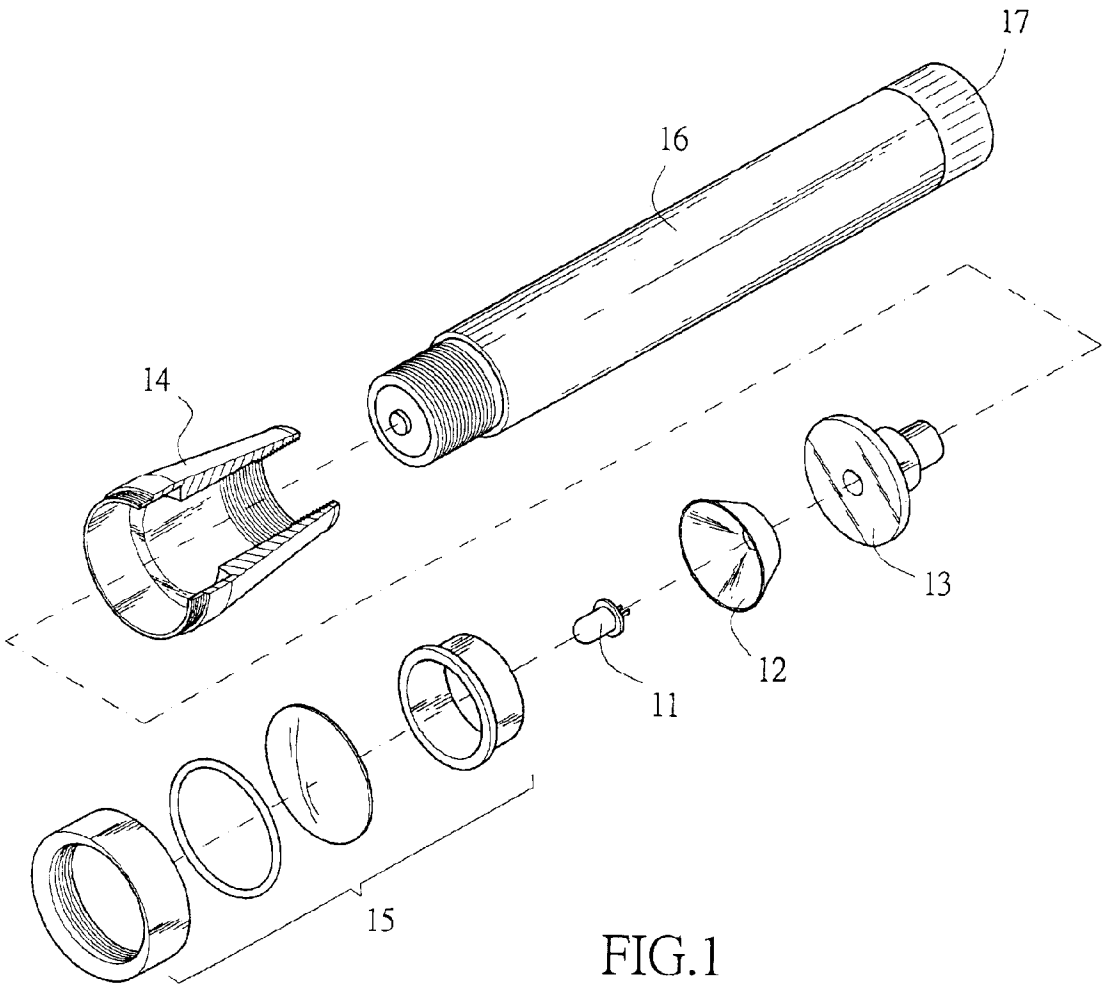
FIG.1 PRIOR ART
FIG. 1 illustrates a high-power flashlight structure according to the prior art.
Figure 2:
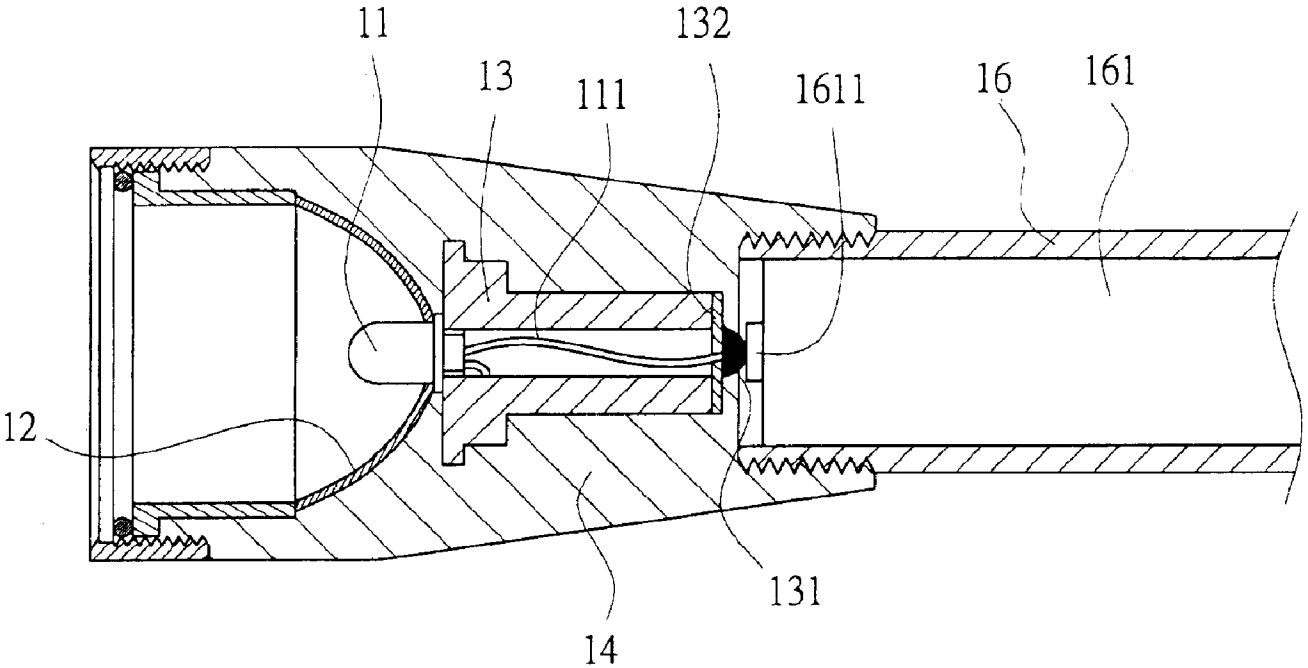
FIG.2 PRIOR ART
FIG. 2 illustrates a cross-section structure of a high-power LED flashlight according to the prior art.
Figure 3:
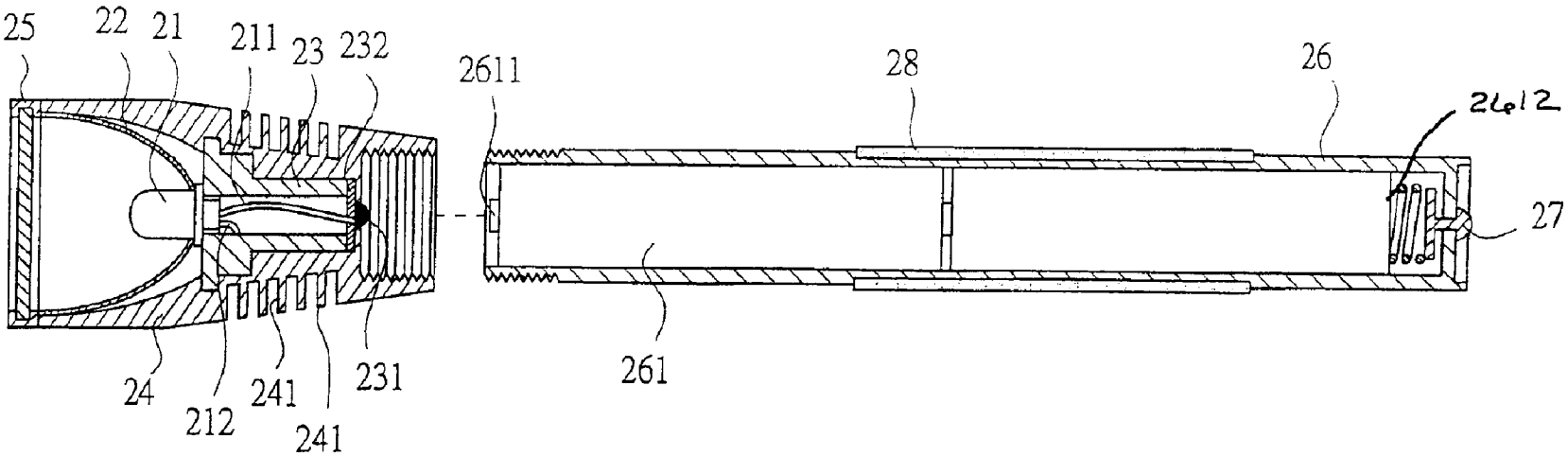
FIG. 3 illustrates a cross-section structure of a high-power LED flashlight according to the present invention.

Please refer to FIG. 3 showing a cross-section structure of a high-power LED flashlight according to the present invention according to a preferred embodiment of the present invention. As being shown in FIG. 3, the flashlight structure includes a base 23 having a conducting point 231 isolated with the base via an isolating piece 232; a high-power luminary 21 disposed on the base 23 and having an anode 211 electrode connecting with the conducting point 231 and a cathode electrode 212 connecting with the base; a power source 261 of a casing having a positive terminal 2611 connecting to the conducting point 231 and a negative terminal 2612 connecting to the base 23 for providing the luminary 21 with power; and a housing 24 including the base 23 and having plural heat sink 241 for dissipating heat produced by the high-power luminary, thereby preventing the high-power luminary 21 of the flashlight structure from damage or diminution of use life. A reflecting piece is located around the luminary 21 for collecting and reflecting light from the luminary. A cover set 25 engaging the housing 24 covers and protects the luminary.

Accordingly, the present invention can be applied to a light emitting diode (LED) 21. The housing 24 and the casing can be made of a heat-conducting and electric-conducting material, for example aluminum alloys. In application, the flashlight structure further includes a switch 27 connected to the casing 26 for controlling a power supply condition of the power source 261 and the casing 26 further includes a holding sleeve 28 disposed around the casing 26 for facilitating of holding, wherein the holding sleeve 28 can be made of a heat-insulating material, such as a rubber. Meanwhile, the base 23 and the housing 24 can be of unity, which is produced by means of metal-injection molding (MIM) process.

Figure 4:
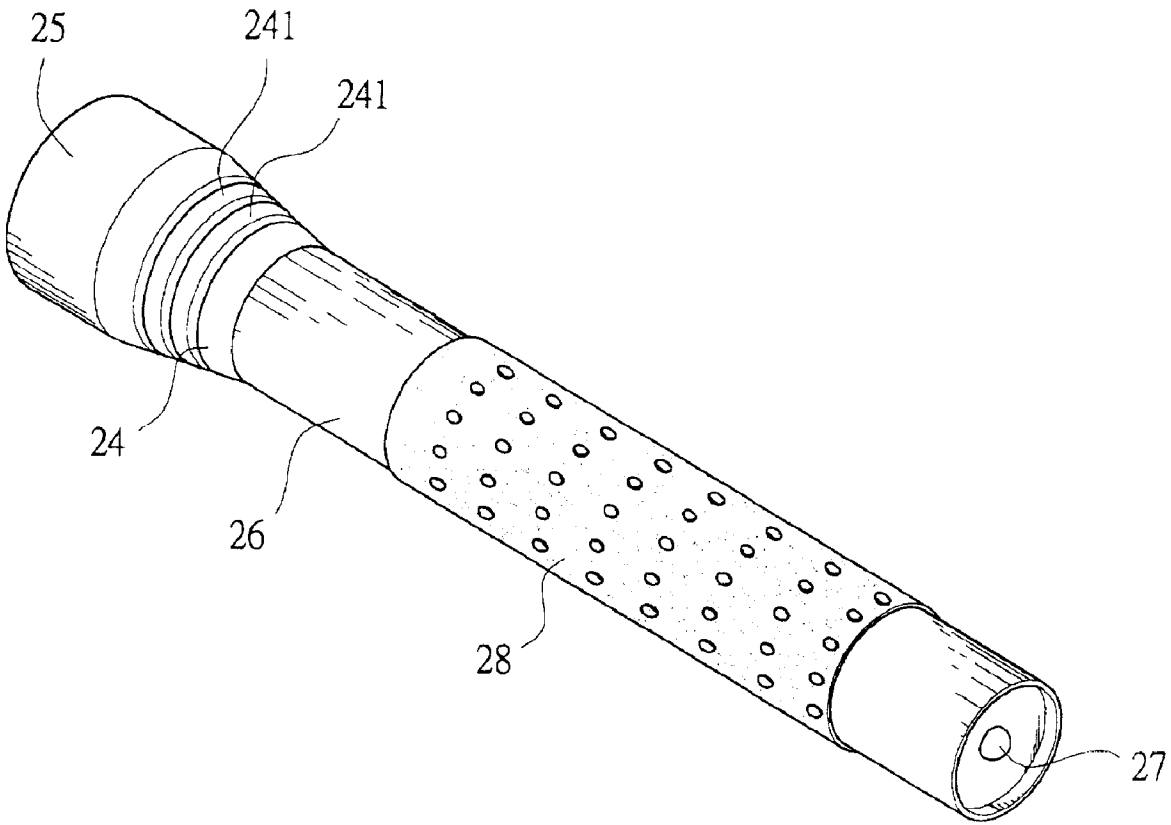
FIG. 4 illustrates a high-power LED flashlight structure according to the present invention.

Please refer to FIG. 4. It illustrates a high-power LED flashlight structure according to the present invention. The flashlight structure of the present invention could include a base 23 having a conducting point 231 isolated with the base 23 via an isolating piece 232; a high-power luminary 21 disposed on the base 23 and having an anode electrode 211 connecting with the conducting point 231 and a cathode electrode 212 connecting with the base 23; a housing 24 including a base 23 and having plural heat sink 241 for dissipating heat produced by the high-power luminary 21; a reflecting piece 22 disposed around the high-power luminary 21 for collecting and reflecting light produced by the high-power luminary 21; and the power source 261 having the positive terminal 2611 connecting to the conducting point 231 and the negative terminal 2612 connecting to the base 23 for providing the high-power luminary 21 with power.

Accordingly, it can be applied to a light emitting diode (LED) 21. The housing 24 and the casing 26 can be made of a heat-conducting and electric-conducting material, for example aluminum alloys. In application, the flashlight structure further includes a switch 27 connected to the casing 26 for controlling a power supply condition of the power source 261 and the casing 26 further includes a holding sleeve 28 disposed around the casing 26 for facilitating of holding, wherein the holding sleeve 28 can be made of a heat-insulating material, such as a rubber. Meanwhile, the base 23 and the housing 24 can be of unity, which is produced by means of metal-injection molding (MIM) process.

In accordance with an additional aspect of the present invention, a housing structure for a flashlight having a high-power luminary 21 is disclosed. The housing structure 24 includes plural heat sink 241 for dissipating heat produced by the high-power luminary 21, thereby preventing the high-power luminary of the flashlight structure from damage or diminution of use life.

Accordingly, the housing structure 24 is made of a heat-conducting and electric-conducting material and the material is an aluminum alloy.

In conclusion, the present invention provides a flashlight structure with a heat-dissipating device, which is capable of preventing the high-power luminary from break, being assembled easily and efficiently, and can rectify those drawbacks of the prior art and solve the above problems. Accordingly, the present invention possesses many outstanding characteristics, effectively improves upon the drawbacks associated with the prior art in practice and application, produces practical and reliable products, bears novelty, and adds to economical utility value. Therefore, the present invention exhibits a great industrial value. While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A flashlight structure comprising:

a) a casing and having a power source;

b) a housing connected to an end of the casing and having a plurality of heat sinks located on an exterior periphery thereof;

c) a base inserted into an interior of the housing adjacent to the plurality of heat sinks and having:

i) an exterior peripheral surface engaging the interior of the housing along a length of the base;

ii) a conducting point electrically connected to a positive terminal of the power source, a negative terminal of the power source is electrically connected to the base; and iii) an isolation piece isolating the conducting point; and d) a luminary having an anode electrode electrically connected to the conducting point and a cathode electrode electrically connected to the base.

2. The flashlight structure according to claim 1, wherein the plurality of heat sinks are located on the housing between the luminary and the conducting point of the base.

3. The flashlight structure according to claim 1, further comprising a holding sleeve located on around an outer periphery of the casing.

4. The flashlight structure according to claim 3, wherein the holding sleeve is made of a heat-insulating material.

5. The flashlight structure according to claim 3, wherein the holding sleeve is made of a rubber material.

6. The flashlight structure according to claim 1, further comprising a switch connected to the power source for selectively controlling a power supply to the luminary.

7. The flashlight structure according to claim 1, further comprising a reflective piece located in the interior of the housing around the luminary, and a cover set located on an end of the housing opposite the casing.

8. The flashlight structure according to claim 1, wherein the luminary is a light emitting diode.

9. The flashlight structure according to claim 1, wherein the base, the housing and the casing are made of a heat-conducting and electric-conducting material.

10. The flashlight structure according to claim 1, wherein the base, the housing and the casing are made of an aluminum alloy.

11. The flashlight structure according to claim 1, wherein the housing and the base are integrally made.

* * * * *